US005988913A

United States Patent [19]

Kageyama et al.

[11] Patent Number: 5,988,913

[45] Date of Patent: Nov. 23, 1999

[54] DOUBLE-CHUCK MECHANICAL PENCIL

[75] Inventors: Hidehei Kageyama; Shouji Anzai; Yoshihide Mitsuya, all of Kawagoe, Japan

[73] Assignee: Kotobuki & Co., Ltd., Kyoto, Japan

[21] Appl. No.: 08/944,191

[22] Filed: Oct. 6, 1997

[30] Foreign Application Priority Data

Oct. 7, 1996 [JP] Japan ..... 8-282868
Mar. 3, 1997 [JP] Japan ..... 9-061754

[51] Int. Cl.[6] ..... A45D 40/04; B43K 21/22

[52] U.S. Cl. ..... 401/52; 401/67

[58] Field of Search ..... 401/52, 67

[56] References Cited

U.S. PATENT DOCUMENTS 4,180,339 12/1979 Katz ..... 401/67
4,240,759 12/1980 Matsumoto et al. ..... 401/67
4,538,934 9/1985 Brunner ..... 401/67
4,714,365 12/1987 Kageyama et al. ..... 401/67
4,872,776 10/1989 Kageyama et al. ..... 401/67
4,957,384 9/1990 Kageyama et al. ..... 401/67
5,015,111 5/1991 Petterson ..... 401/52
5,662,425 9/1997 Mitsuya ..... 401/52
5,683,191 11/1997 Kageyama et al. ..... 401/52

FOREIGN PATENT DOCUMENTS 2742269 3/1951 Switzerland ..... 401/67

*Primary Examiner*—Charles R. Eloshway
*Attorney, Agent, or Firm*—Rothwell, Figg, Ernst & Kurz

[57] ABSTRACT

In a double-chuck mechanical pencil provided with an eraser, the torsional breakage of a lead gripped by a front lead chuck and a back lead chuck due to the turning of a lead tank caused when an eraser is used is prevented, and inconvenience to a lead supplying operation caused by the abrasion of the eraser is eliminated.

6 Claims, 14 Drawing Sheets

DOUBLE-CHUCK MECHANICAL PENCIL

BACKGROUND OF THE INVENTION

1. Field of the Invention

The present invention relates to a double-chuck mechanical pencil provided with a front chuck for gripping a lead, and a back chuck provided with a chuck ring loosely put thereon to project a lead by a fixed length and, more particularly, to a double-chuck mechanical pencil provided with an eraser support structure in its back portion.

2. Prior Art

There have been proposed various double-chuck mechanical pencils incorporating improvements to reduce waste leads. In the double-chuck mechanical pencil of this kind, if either the front or the back chuck is turned by some cause while a lead is gripped by both the front and the back chuck, the lead is twisted and broken. Fragments of the broken lead remaining in a space between the front and the back chuck obstruct a lead projecting operation, and a front portion and a back portion of the broken lead are dislocated relative to each other in projecting the broken lead to make the projection of the broken lead impossible.

If the user turns a push cap or an eraser holder connected through a lead tank to the back chuck inadvertently or the back chuck is turned together with the lead tank when an eraser is used, a lead gripped by both the front and the back chuck is twisted and broken.

SUMMARY OF THE INVENTION

Accordingly, it is an object of the present invention to provide a double-chuck mechanical pencil with an eraser, having a barrel, a lead tank, an adapter combined with the barrel and the lead tank so that chucks are able to slide axially and unable to rotate, and restraining means provided on the adapter and a rubber eraser support member to prevent the torsional breakage of a lead.

A mechanical pencil of this kind has complicated internal mechanisms and a sufficient space for containing an eraser cannot be secured in a back portion of the barrel of the mechanical pencil. Such a problem is more serious in a double-chuck mechanical pencil provided with a lead holding chuck and a lead advancing chuck to reduce waste leads.

Pencil marks drawn on a paper sheet with the mechanical pencil can be rubbed out with an eraser, because scraps of rubber are produced when the surface of the paper sheet is rubbed with the eraser, and the scraps of rubber adsorb and envelop carbon particles forming the pencil marks. Therefore, the eraser is abraded and worn out rapidly. The present invention has been made taking into consideration the complicated structure of double-chuck mechanical pencils and the characteristics of the eraser and it is an object of the present invention to enable an eraser projecting mechanism to be easily removed regardless of the change in shape of the eraser and to enable the eraser to be projected by an appropriate length when the same is abraded.

Another object of the present invention is to eliminate structural disadvantages of an eraser, to enable the use of either of a plastic eraser and a rubber eraser without trouble, to overcome difficulty in directly removing a worn or deteriorated eraser when replenishing the mechanical pencil with leads, and to provide an eraser support structure capable of being easily removed without making finger tips dirty with a dirty eraser.

A third object of the present invention is to enable an eraser to be put relatively easily on a back portion of a mechanical pencil regardless of the size and the shape thereof and manufacturing errors therein, to enable the mechanical pencil to be replenished easily and accurately with leads, to avoid torsionally breaking a lead chucked in a front lead chuck and a back lead chuck by the turning of the back lead chuck together with a lead tank turned by the eraser when the eraser is used.

A fourth object of the present invention is to prevent a lead from being held in a space between a barrel and a lead tank of a diameter different from that of the barrel, and the lead tank from rattling when an eraser is used by providing an adapter serving as a spacer between the barrel and the lead tank.

According to a first aspect of the present invention, there is provided a double-chuck mechanical pencil having a front lead chuck for holding a lead and a back lead chuck for advancing a lead, comprising: a barrel; a lead tank connected to the back lead chuck; an adapter fixedly put on a back portion of the lead tank, restrained from rotation relative to the barrel and axially movable; and a rotary eraser projecting mechanism provided with a support member restrained from rotation relative to the adapter, detachably connected to a back portion of the adapter.

According to a second aspect of the present invention, there is provided a double-chuck mechanical pencil having a front lead chuck for holding a lead and a back lead chuck for advancing a lead, said double-chuck mechanical pencil comprising: a barrel; a lead tank connected to the back lead chuck; an adapter fixedly put on a back portion of the lead tank, restrained from rotation relative to the barrel and axially movable; and an eraser support structure provided with a support member restrained from rotation relative to the adapter, and detachably connected to a back portion of the adapter.

According to a third aspect of the present invention, there is provided a double-chuck mechanical pencil having a front lead chuck for holding a lead and a back lead chuck for advancing a lead, comprising: a barrel provided with a detaining means on the inner circumference thereof, a lead tank connected to the back lead chuck; an adapter fixedly put on a back portion of the lead tank, having an expanded front portion receiving the lead tank therein and provided with a detaining means on the outer circumference thereof, restrained from rotation relative to the barrel and axially movable; and an eraser support member provided on a back portion of the adapter.

DETAILED DESCRIPTION OF THE PREFERRED EMBODIMENTS

Figure 1:
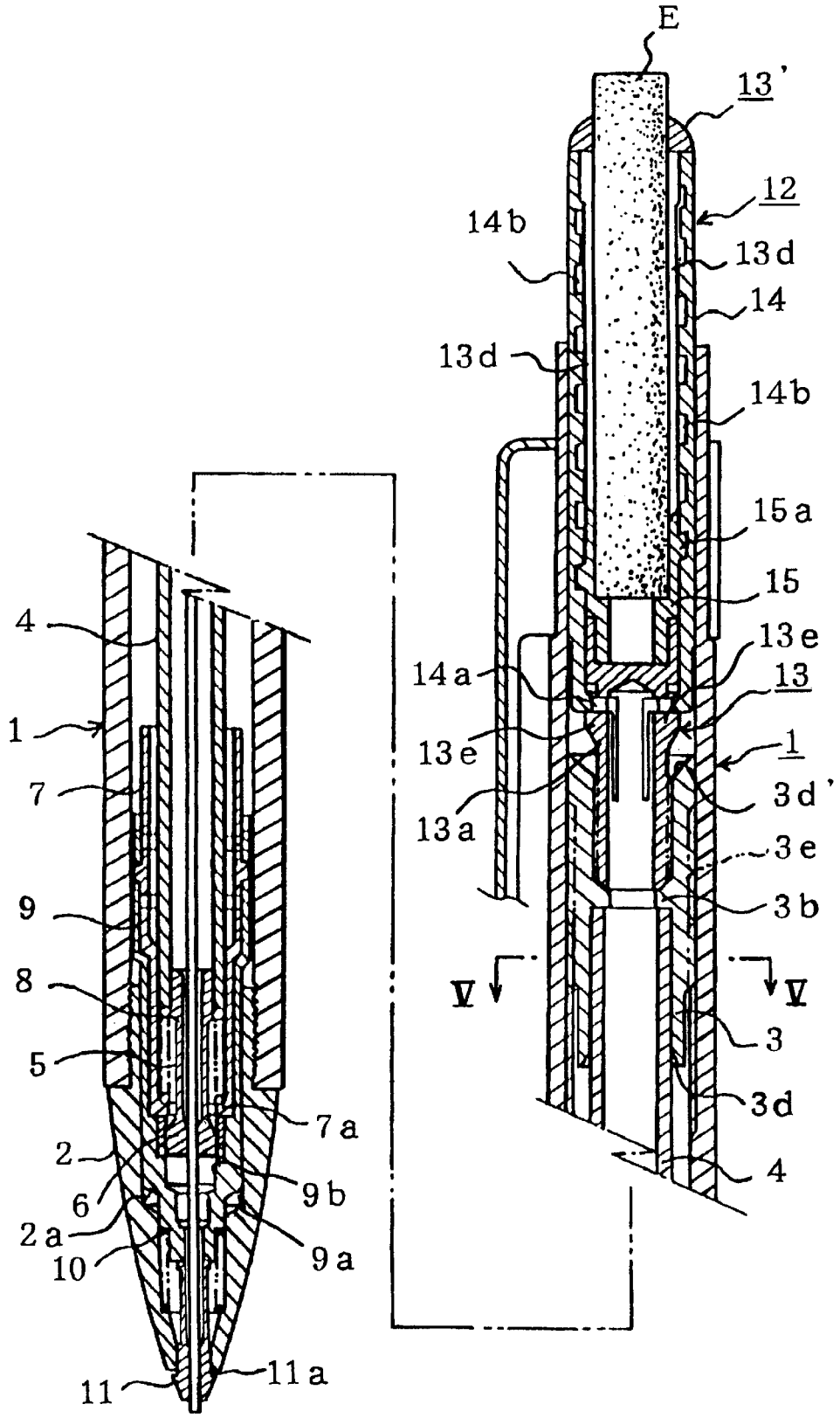
FIG. 1 is a longitudinal sectional view of a double-chuck mechanical pencil in a first embodiment according to the present invention.
Figure 2:
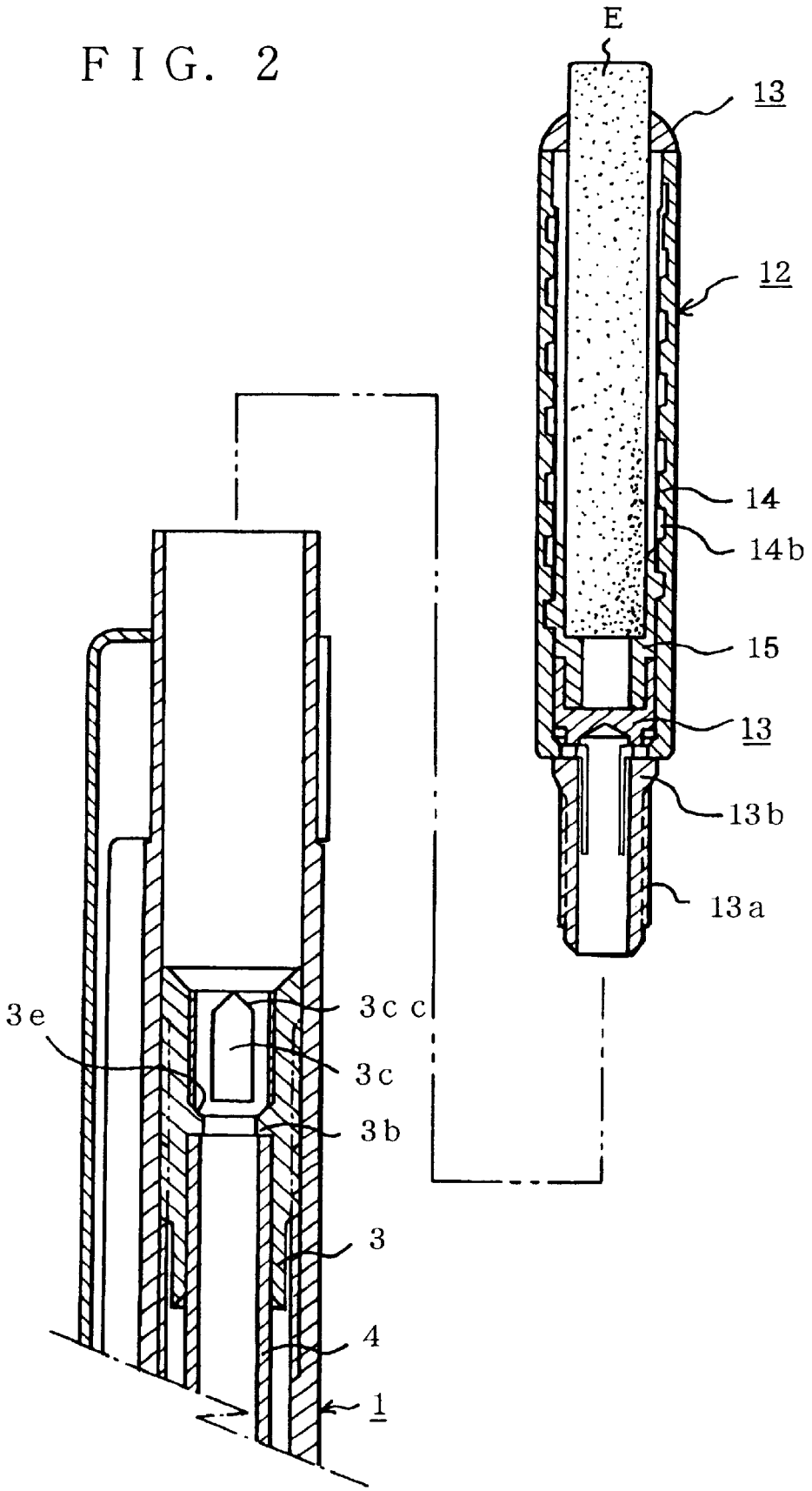
FIG. 2 is a longitudinal sectional view of a back portion of the double-chuck mechanical pencil of FIG. 1 in a state where a rotary eraser projecting mechanism is taken out.

Preferred embodiments of the present invention will be described hereinafter with reference to the accompanying drawings.

First Embodiment

Referring to FIGS. 1 to 7 showing a double-chuck mechanical pencil in a first embodiment according to the present invention and parts included therein, a head cap 2 is screwed into the forward end of a barrel 1, a lead tank 4 is inserted axially slidably in the barrel 1, and an adapter 3 is fixed to a back end of the lead tank 4 to restrain the lead tank 4 from turning relative to the barrel 1. A back lead chuck 5 for advancing a lead is fixedly forced into a front end portion of the lead tank 4, and a chuck ring 6 is loosely put on the front end portion of the back lead chuck 5.

An elastic tube 7 is disposed in contact with the back end of the chuck ring 6, and a back spring 8, i.e., an elastic member, is extended between the elastic tube 7 and the front end of the lead tank 4. The elastic tube 7 is provided with an inner flange 7*a* at its front end, and the front end of the back spring 8 is seated on the inner flange 7*a*. The back spring 8 biases the lead tank 4 backward relative to the barrel 1.

A connector 9 is put on the elastic tube 7 by a stopping structure so as to sheathe the elastic tube 7 therein. A front spring 10 is extended between a reduced front end portion of the connector 9 and the inner surface of the head cap 2 to bias the connector 9 backward. A front lead chuck 11 for holding the lead is fixedly forced in a front end of the reduced portion of the connector 9. Incidentally, the elasticity of the front spring 10 is preset so as to be weaker than that of the back spring 8.

The front lead chuck 11, when advanced relative to the head cap 2, holds the lead by a holding force adequate to prevent the lead from falling off the front lead chuck 11 and to permit the lead to move if an axial force is applied to the lead. The front lead chuck 11 is provided with a circumferential stopping shoulder 11*a* in a portion thereof projecting from the tip of the head cap 2.

The front lead chuck 11, when retracted relative to the head cap 2, is capable of exerting a holding force on the lead to hold the lead immovably against a pressure that acts on the lead during writing. In FIG. 1, indicated at 12 is a unit rotary eraser projecting mechanism disposed behind the lead tank 4.

Figure 4:
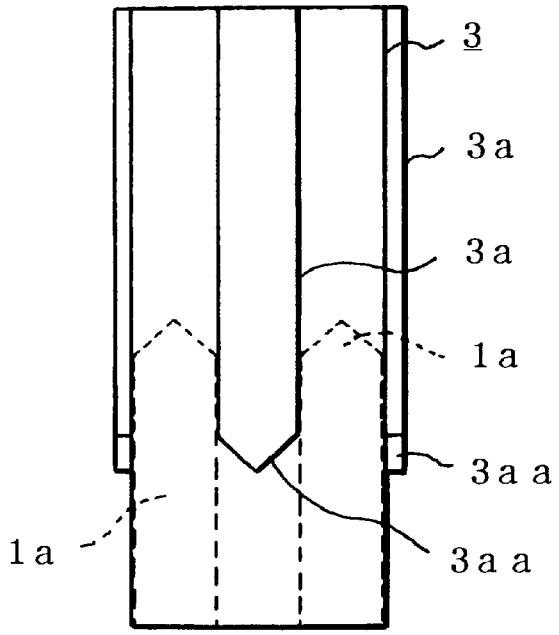
FIG. 4 is a front view of an adapter included in the double-chuck mechanical pencil of FIG. 1, in which longitudinal ribs formed on the inner circumference of a barrel are indicated by dotted lines.

As mentioned above, the adapter 3 is fixed to the back portion of the lead tank 4. As best shown in FIG. 4, the adapter 3 is provided on its outer circumference with four longitudinal ribs 3*a* arranged at equal angular intervals. Each of the longitudinal ribs 3*a* has a tapered front end 3*aa,* which serves as a guide when the adapter 3 is inserted in the barrel 1 so that the longitudinal ribs 3*a* engage with longitudinal ribs 1*a* formed on the inner circumference of the barrel 1. Therefore, the adapter 3 need not be positioned at a specific angular position relative to the barrel 1 when assembling the barrel 1 and the adapter 3.

The adapter 3 is provided in the middle portion of the inner circumference thereof with a circular ridge 3*b* for positioning a support member 13 of the rotary eraser projecting mechanism 12. Longitudinal ribs 3*c* for restraining the adapter 3 from turning is extended behind the circular ridge 3*b*. Each of the longitudinal ribs 3*c* has a tapered back end 3*cc* which serves, similarly to the tapered front end 3*aa,* as a guide when engaging the longitudinal ribs 3*c* with longitudinal ribs 13*b* formed on the support member 13.

The inner edge of the front end of the adapter 3 is chamfered in a bevel surface 3*d* to facilitate the insertion of the back end of the lead tank 4 into the front end of the adapter 3 during assembly of the mechanical pencil. Also, the inner edge of the back end of the adapter 3 is chamfered in a bevel surface 3*d*' to facilitate the replenishment of the lead tank 4 with leads and the insertion of the support member 13 of the rotary eraser projecting mechanism 12 into the back end of the adapter 3. The circular ridge 3*b* formed in the middle portion of the inner circumference of the adapter 3 has a bevel back surface 3*e* expanded toward the back so that leads can be smoothly supplied into the lead tank 4.

Figure 3:
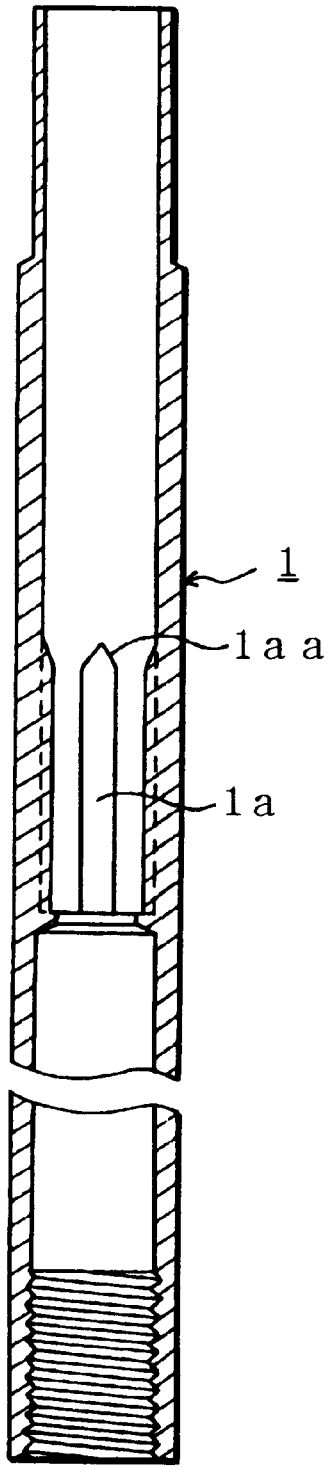
FIG. 3 is a longitudinal sectional view of a barrel included in the double-chuck mechanical pencil of FIG. 1.
Figure 5:
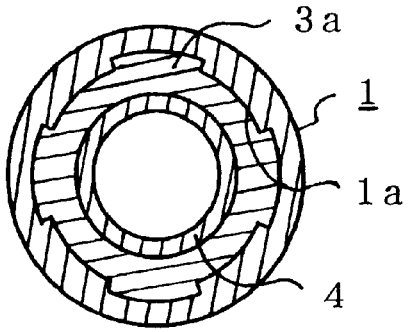
FIG. 5 is a sectional view taken on line A—A in FIG. 1.

As shown in FIGS. 3 and 5, the barrel 1 is provided on its inner circumference with four longitudinal ribs 1*a* arranged at equal angular intervals to restrain the adapter 3 from turning relative to the barrel 1. The longitudinal ribs 1*a* of the barrel 1 and the longitudinal ribs 3*a* of the adapter 3 are engaged as shown in FIGS. 4 and 5. The position and the length of the longitudinal ribs 1*a* of the barrel 1 are determined properly taking into consideration the stroke of the lead tank 4 which is pushed to project the lead.

Figure 6:
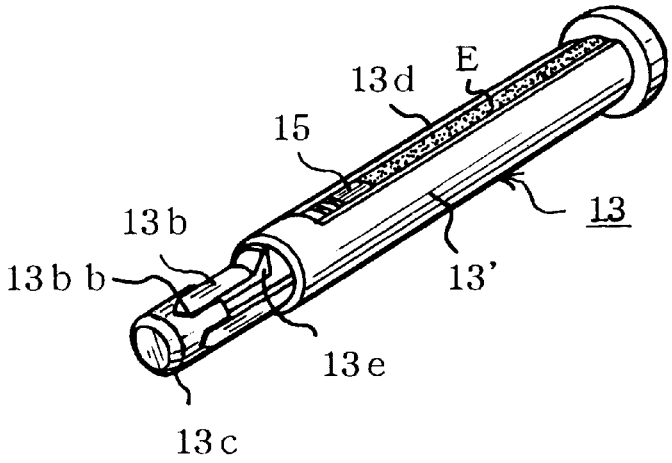
FIG. 6 is a perspective view of an essential portion of an eraser projecting mechanism included in the double-chuck mechanical pencil of FIG. 1.
Figure 7:
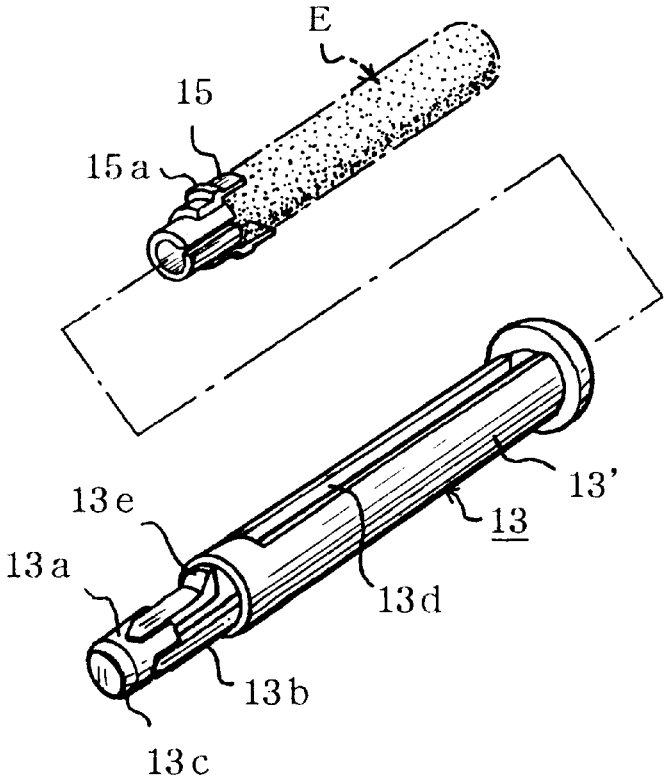
FIG. 7 is an exploded perspective view similar to FIG. 6.

The support member 13 included in the eraser projecting mechanism 12 includes a substantially tubular portion 13' and a leg portion 13*a* provided on its outer circumference with the longitudinal ribs 13*b* (FIGS. 6 and 7). The longitudinal ribs 13*b* are engaged with the longitudinal ribs 3*c* (FIG. 2) extended backward from the circular ridge 3*b*. The outer edge of the front end of the leg portion 13*a* of the support member 13 is chamfered to form a bevel surface 13*c* mating with the bevel back surface 3*e* of the circular ridge 3*b*. The support member 13, the circular rib 3*b* of the adapter 3 and the lead tank 4 are formed so that their inside diameters are substantially the same to facilitate the movement of leads through the support member 13 and the lead tank 4.

The eraser projecting mechanism 12 will be described with reference to FIGS. 6 and 7 showing an essential portion thereof. A helical groove 14*b*, i.e., a helical means, is formed in the inner circumference of a guide tube 14 (FIG. 1) rotatably mounted on the tubular portion 13' of the support member 13. The four longitudinal ribs 13*b* are arranged on the leg portion 13*a* of the support member 13 at equal angular intervals. Each of the longitudinal ribs 13*b* has a tapered front end 13*bb*. A pair of longitudinal slots 13*d* are formed behind the longitudinal ribs 13*b* in the support member 13. An eraser holding member 15 is movably inserted in the tubular portion 13' of the support member 13. The holding member 15 is provided with projections 15*a*. The projections 15*a* of the eraser holding member 15 are projected outward through the slots 13*d* and engaged with the helical groove 14*b* of the guide tube 14.

Projections 13*e* are formed by raising portions of the support member 13. The projections 13*e* are engaged with an inwardly facing flange 14*a* formed on the guide tube 14. A restraining means for restraining the leg portion 13*a* of the support member 13 from turning and allowing the same to move axially comprises the four longitudinal ribs 3*c* (FIG. 2) formed at equal angular intervals on the inner circumference of the adapter 3, and the longitudinal ribs 13*b* formed on the outer circumference of the leg portion 13*a* of the support member 13 and in engagement with the longitudinal ribs 3*c* of the adapter 3.

The operation of the double-chuck mechanical pencil in the first embodiment will be described hereinafter. The back end of the eraser projecting mechanism 12 is pushed by a user's finger. First the front spring 10 is compressed since the front spring 10 is weaker in elasticity than the back spring 8 as discussed above, so that the front lead chuck 11 is advanced and opens in a state for receiving a lead through its back end.

Subsequently, the tapered shoulder 9*a* of the connector 9 comes into contact with a step 2*a* formed in the inner surface of the head cap 2, and then the back spring 8 is compressed to advance the back lead chuck 5 together with the lead tank 4. During the advancement of the back lead chuck 5, the chuck ring 6 comes into contact with a step 9*b* formed on the inner circumference of the connector 9, so that the back lead chuck 5 is opened to allow a lead to be advanced. Then, the eraser projecting mechanism 12 is released from the user's finger. At this time, the back lead chuck 5 is returned to its initial position. Then, the eraser projecting mechanism 12 is pushed again to advance the back lead chuck 5. The back lead chuck 5 holding the lead advances in the connector 9 to advance the lead through the front lead chuck 11.

The lead is advanced further through the front lead chuck 11 and is projected from the front lead chuck 11. When a portion of the lead projecting from the front lead chuck 11 is abraded, the eraser projecting mechanism 12 is pushed to feed the lead so that the lead is advanced by an appropriate distance. When the lead is abraded to a minimum limit length, the foregoing eraser projecting mechanism pushing operation is repeated to feed a new lead to push the abraded lead out through the front lead chuck 11 by the new lead.

If an excessively long portion of the lead is projected from the front lead chuck 11, the lead can be pushed back into the double-chuck mechanical pencil by pushing the eraser projecting mechanism 12 to open the lead chucks 5 and 11 slightly and pressing the lead at its point so that the lead is projected from the front lead chuck 11 by an appropriate length to avoid the breakage of the lead.

If an error is made in writing using the mechanical pencil of the present invention, the barrel 1 is held fast and the guide tube 14 is turned relative to the barrel 1 to project an eraser from the eraser projecting mechanism 12. Since the support member 13 of the eraser projecting mechanism 12 is restrained from turning relative to the adapter 3 by the engagement of the longitudinal ribs 13*b* and 3*c*, the eraser holding member 15 is driven by the helical groove 14*b* of the guide tube 14 so as to move backward along the slots 13*c* of the support member 13 when the guide tube 14 is turned, so that a portion of the eraser is projected from the back end of the guide tube 14.

A considerably large torque acts on the eraser when the eraser is used to rub the surface of a paper sheet. Since the support member 13 is restrained from turning relative to the adapter 3 by the engagement of the longitudinal ribs 13*b* and 3*c*, and the adapter 3 is restrained from turning relative to the barrel 1 by the engagement of the longitudinal ribs 3*a* and 1*a*, the torque acting on the eraser is not transmitted to the back lead chuck 5 connected to the lead tank 4, and the back lead chuck 5 is not turned relative to the front lead chuck 11, so that the lead gripped by the back lead chuck 5 and the front lead chuck 11 will not be torsionally broken. The adapter 3 serves also as a spacer for avoiding difficulty in erasing pencil marks with the eraser due to the unsteady movement of the support member 13 and lead tank 4. The guide tube 14 is turned in the reverse direction to retract the eraser into the support member 13.

An operation for replenishing the lead tank 4 with new leads will be described hereinafter. The leg portion 13*a* of the support member 13 is pulled out of the adapter 3 fixed to the back portion of the lead tank 4 by pulling the guide tube 14. Since the eraser projecting mechanism 12 is formed in a unit, and the leg portion 13*a* of the support member 13 is simply inserted in the adapter 3 so that the longitudinal ribs are engaged, the eraser projecting mechanism 12 can be easily removed simply by pulling the guide tube 14. Since the bevel surfaces 3*d* and 3*e* are formed at the opposite ends of the adapter 3, new leads can be smoothly supplied through the open back end of the barrel 1 through the adapter 3 into the lead tank 4.

Second Embodiment

Figure 8:
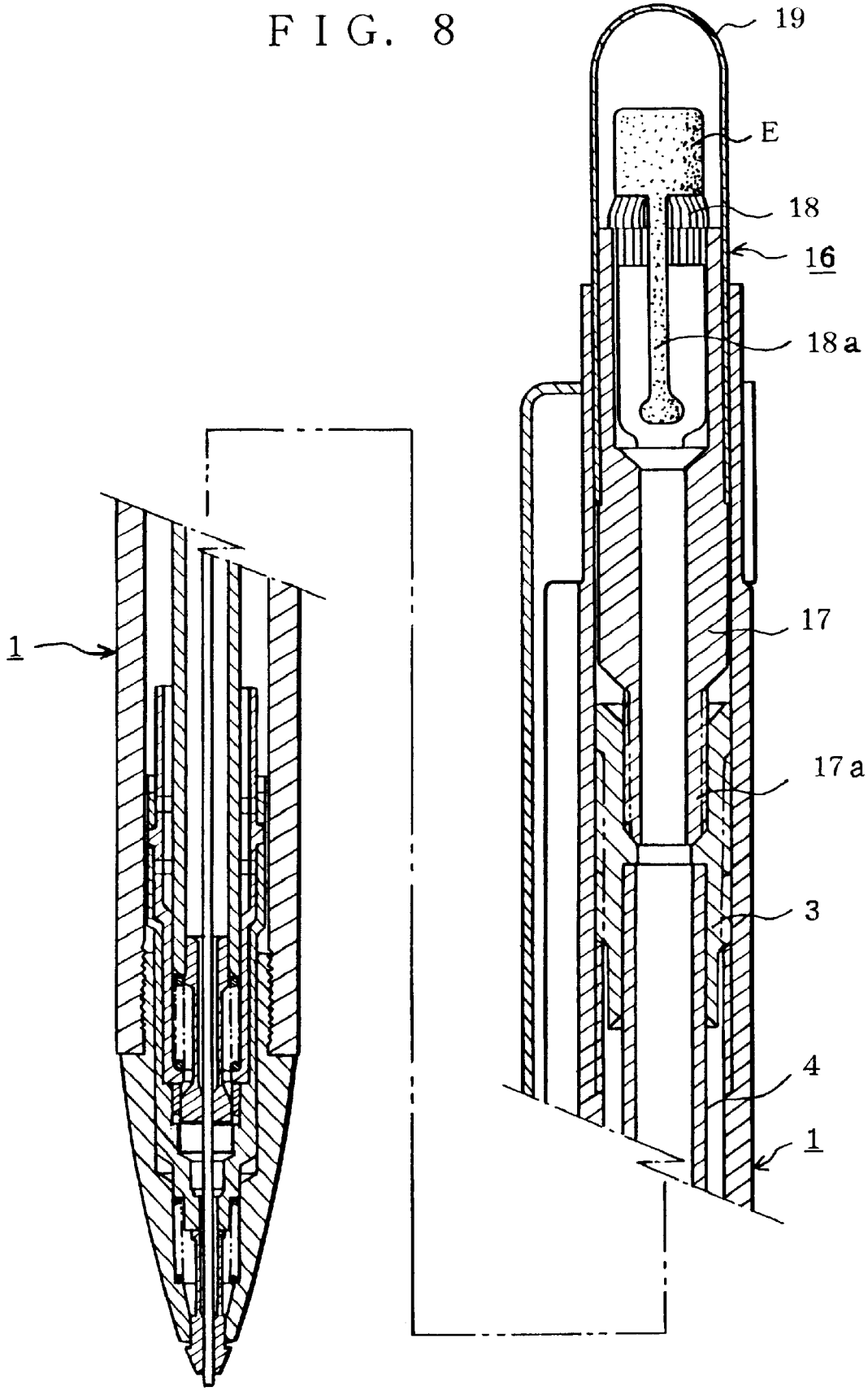
FIG. 8 is a longitudinal sectional view of a double-chuck mechanical pencil in a second embodiment according to the present invention.

FIG. 8 is a longitudinal sectional view of a double-chuck mechanical pencil in a second embodiment according to the present invention. Mechanisms including a front lead chuck and a back lead chuck and formed in a front portion of the double-chuck mechanical pencil are the same as the corresponding mechanisms of the double-chuck mechanical pencil in the first embodiment and hence the description thereof will be omitted. The double-chuck mechanical pencil in the second embodiment is provided with an eraser support structure 16 instead of the rotary eraser projecting mechanism 12 of the first embodiment.

The eraser support structure 16 will be described hereinafter. The eraser support structure 16 comprises a tubular support member 17 having a leg portion 17*a* provided on its outer circumference with longitudinal ribs similar to the longitudinal ribs 13*b* of the support member 13 employed in the first embodiment, and a bottomed eraser jacket 18 fitted in a bore formed in a back portion of the support member 17. An eraser jacketed by the eraser jacket 18 is covered with a push cap 19 detachably inserted in an annular space between a barrel 1 and the support member 17.

The double-chuck mechanical pencil in the second embodiment, similarly to that in the first embodiment, advances and projects a lead when the push cap 19 is pushed. When using the eraser, the push cap 19 is removed. When a back portion of the eraser projecting from the eraser jacket 18 is abraded, the eraser jacket 18 jacketing the eraser is removed from the support member 17, the eraser jacket 18 provided with a slit 18*a* is expanded elastically to expand the slit 18*a* so that the eraser is able to move relative to the eraser jacket 18, a proper length of the eraser is pulled out from the eraser jacket 18, and then the eraser jacket 18 is allowed to return to its natural shape to hold the eraser.

Then, the eraser jacket 18 jacketing the eraser is attached to the support member 17 of the eraser support structure 16. The lead tank 4 can be replenished with spare leads without touching the eraser and without removing the eraser from the eraser support structure 16 by removing the push cap 19 and pulling out the eraser support structure 16.

Figure 9:
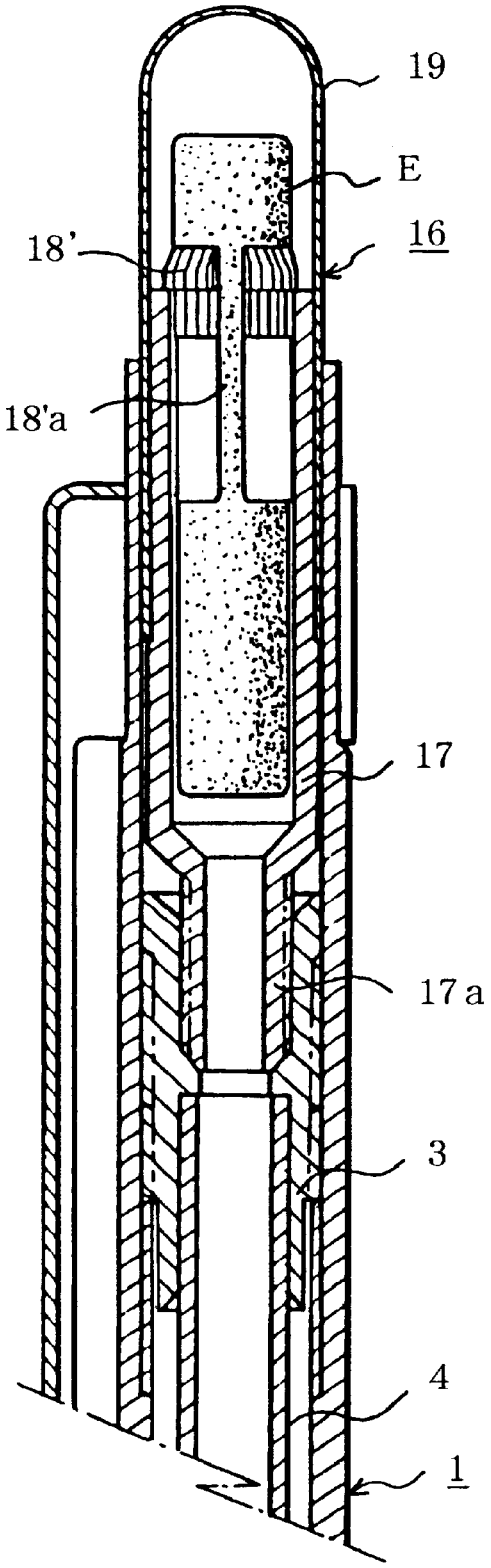
FIG. 9 is a fragmentary longitudinal sectional view of a double-chuck mechanical pencil, showing an eraser jacket in a modification of an eraser jacket included in the double-chuck mechanical pencil of FIG. 8.

FIG. 9 is a fragmentary longitudinal sectional view of an eraser jacket 18' in a modification of the eraser jacket 18 shown in FIG. 8. The eraser jacket 18' is bottomless and has a C-shaped cross section. An eraser support structure 16 shown in FIG. 9 employing the jacket 18' needs a less number of parts than the rotary eraser projecting mechanism shown in FIG. 1, is able to employ an eraser of a diameter greater than that of the eraser employed in the rotary eraser projecting mechanism shown in FIG. 1, and is able to employ an eraser longer than that employed in the eraser support structure 16 employing the eraser jacket 18. Since the eraser jacket 18' is bottomless, the eraser jacket 18' is held at the back end of a support member 17 with an eraser jacketed by the eraser jacket 18' inserted into the depth of the support member 17. When a back portion of the eraser projecting from the eraser jacket 18' is abraded, the eraser jacket 18' jacketing the eraser is removed from the support member 17, the eraser jacket 18' provided with a slit 18*a'* is expanded elastically to expand the slit 18*a'* so that the eraser is able to move relative to the eraser jacket 18', a proper length of the eraser is pulled out from the eraser jacket 18', the eraser jacket 18' is allowed to return to its natural shape to hold the eraser, and then the eraser jacket 18' is put on the support member 17.

Figure 10:
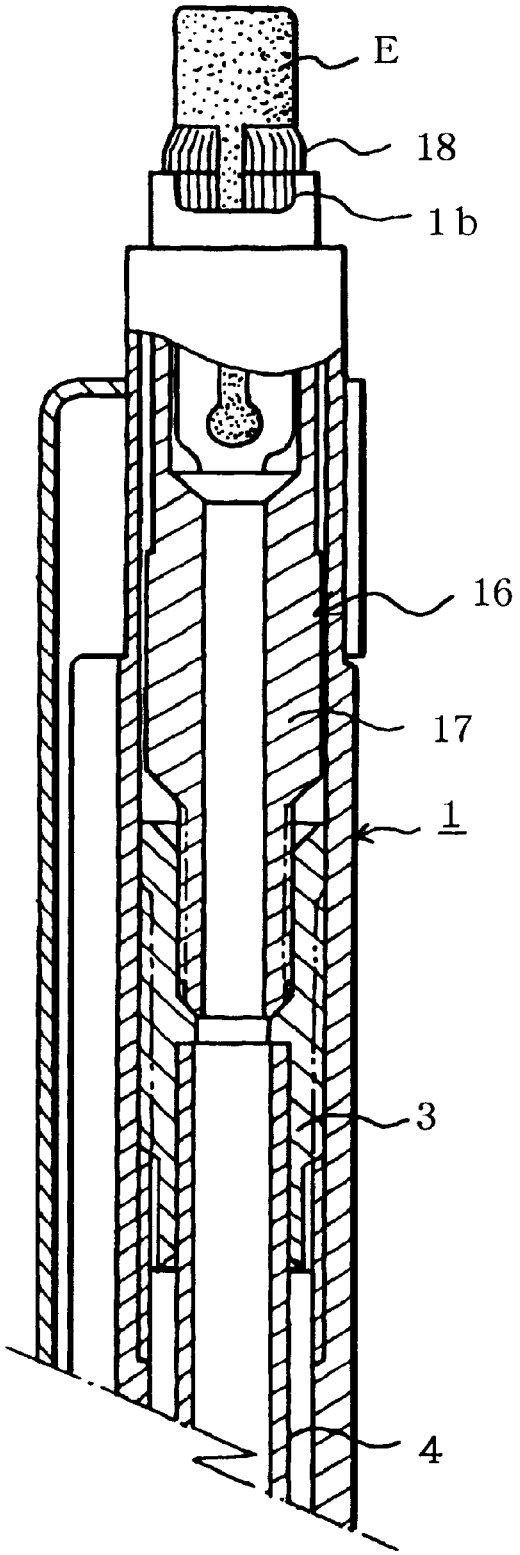
FIG. 10 is a fragmentary longitudinal sectional view of a double-chuck mechanical pencil in a modification of the double-chuck mechanical pencil of FIG. 8.

FIG. 10 shows a barrel 1 in a modification of the barrel 1 shown in FIG. 8. The barrel 1 shown in FIG. 10 is provided with a pair of recesses 1*b* in its back end to facilitate the removal of the eraser support structure 16. The support member 17 can be further firmly held between fingers when removing the eraser support structure 16 from the barrel 1 to replenish the lead tank 4 with spare leads.

A push cap 19 is detachably fitted in a rear end portion of the support member 17. The fit between the push cap 19 and the support member 17 must be looser than that between the adapter 3 and the support member 17. More specifically, it is desirable that a force necessary for pulling off the push cap 19 from the support member 17 is in the range of 100 dyn to 400 dyn, and a force necessary for pulling the support structure from the adapter 3 is in the range of 800 dyn to 1000 dyn. If a force necessary for separating the adapter 3 from the lead tank 4 is 2000 dyn or above, the reverse fit or undesirable disengagement between the push cap 19 or the support member 17 will never occur.

Figure 11:
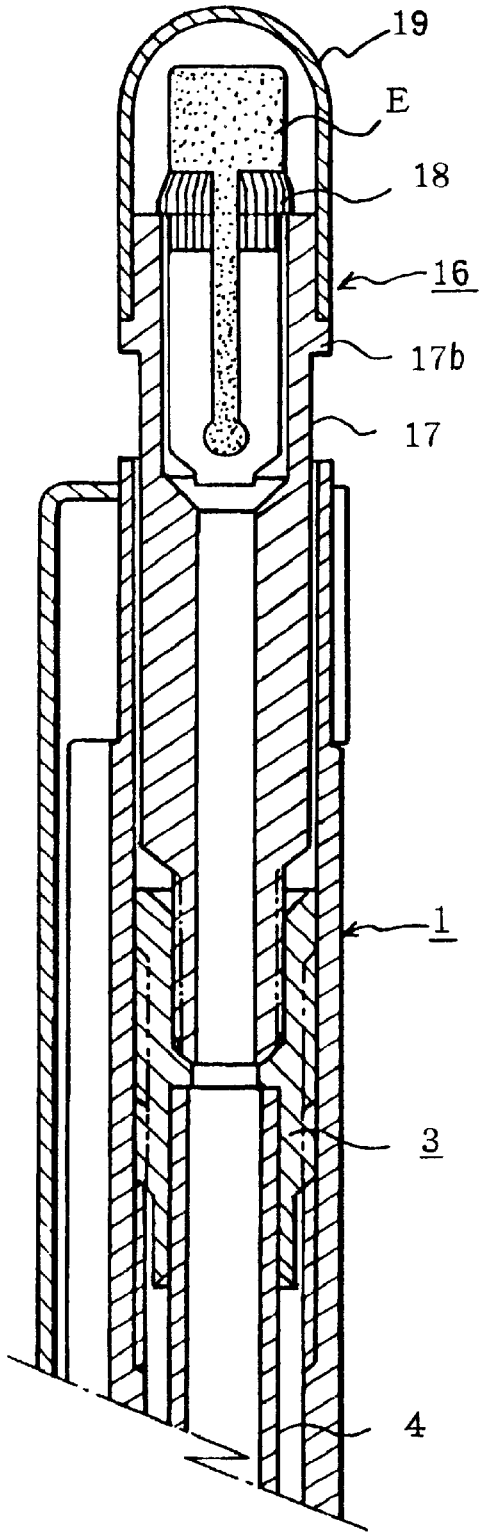
FIG. 11 is a fragmentary longitudinal sectional view of a double-chuck mechanical pencil in a modification of the double-chuck mechanical pencil of FIG. 8, showing an eraser support structure.

FIG. 11 is a fragmentary longitudinal sectional view of an eraser support structure 16 in a modification of the eraser support structure 16 shown in FIG. 8. Referring to FIG. 11, a push cap 19 is detachably put on a back portion of a support member 17 included in the eraser support structure 16 in a manner different from that in which the push cap 19 of the foregoing embodiment is put on the support member 17. In this modification, the push cap is put on the back portion of the support member 17 with its lower end seated on a flange 17*a* formed in a portion of the support member 17 projecting from the back end of a barrel 1. The barrels 1 shown in FIGS. 8, 9 and 11 may be provided in their back ends with recesses similar to the recesses 1*b* shown in FIG. 10.

When replenishing the lead tank 4 with spare leads, the eraser support structure 16 can be easily removed from the barrel 1 by holding the support member 17 with fingers in the portion of thereof projecting from the barrel 1 without removing the push cap 19 from the support member 17. The flange 17*a* facilitate seizing hold of the support member 17 with fingers and pulling out the support member 17 from the barrel 1.

Although the foregoing embodiments employ the four longitudinal ribs formed on the outer circumference and four longitudinal ribs formed on the inner circumference to restrain the support members 13 and 17 from turning relative to the adapter 3, and to restrain the adapter 3 from turning relative to the barrel 1, any suitable number of longitudinal ribs may be used and any suitable restraining means for such a purpose other than the restraining means employing the longitudinal ribs may be employed. For example, a support member, an adapter and a barrel respectively having polygonal cross sections may be used in combination.

Third Embodiment

Figure 12:
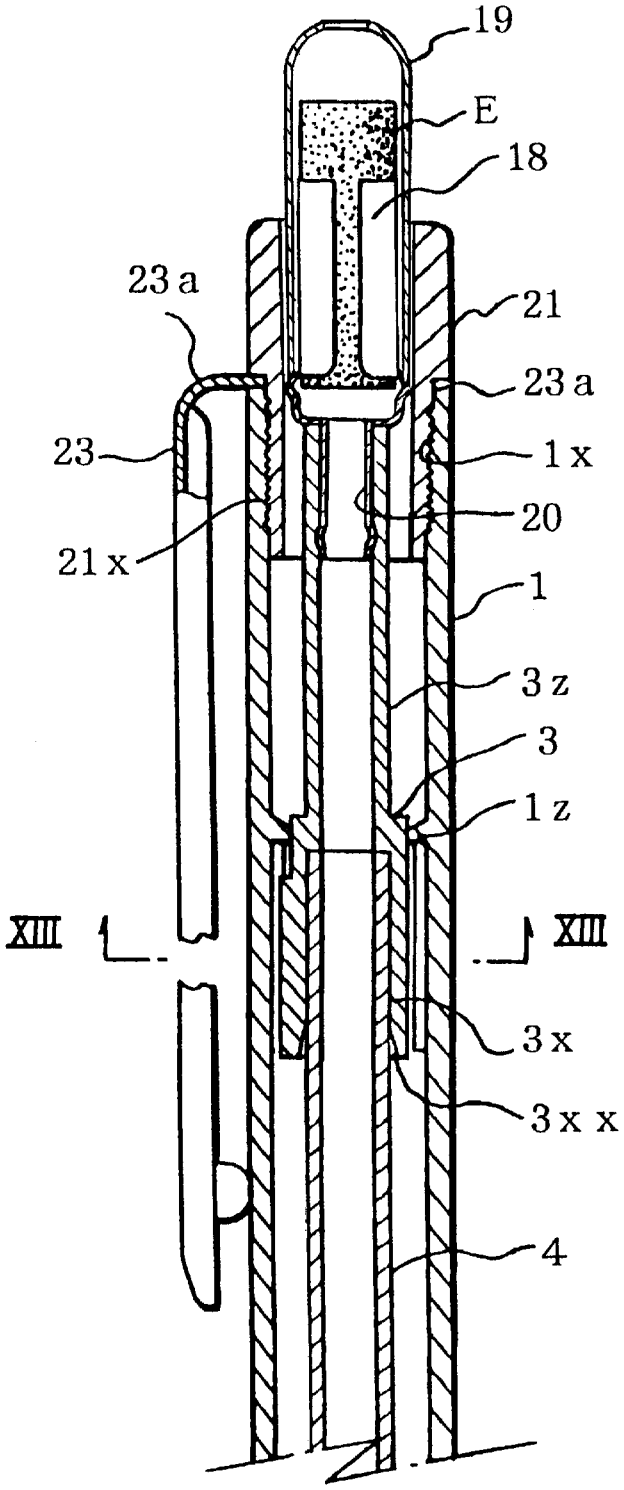
FIG. 12 is a longitudinal sectional view of a double-chuck mechanical pencil in a third embodiment according to the present invention.

FIG. 12 is a longitudinal sectional view of a double-chuck mechanical pencil in a third embodiment according to the present invention. Mechanisms including a front lead chuck and a back lead chuck and formed in a front portion of the double-chuck mechanical pencil of FIG. 12 are the same as the corresponding mechanisms of the double-chuck mechanical pencil in the first embodiment shown in FIG. 1 and hence the description thereof will be omitted. In the double-chuck mechanical pencil in the third embodiment, an adapter 3 has an expanded front portion 3*x*, a back end portion of a lead tank 4 is forced into the expanded front end portion 3*x* of the adapter 3, and an eraser holding member 20 is fixedly pressed in a back end portion of the adapter 3. The inner edge of the front end of the adapter 3 is beveled in a taper surface 3*xx* to facilitate the insertion of the lead tank 4 in the expanded front end portion 3*x* of the adapter 3.

An internal thread 1*x* is formed in a back end portion of the barrel 1, an externally threaded portion 21*x* of an end cap 21 is screwed in the back end portion of the barrel 1, and ring 23*a* of a clip 23 is held between the back end of the barrel 1 and the end cap 21. An eraser jacket 18 jacketing an eraser is detachably attached to the eraser holding member 20. A push cap 19 is detachably put on the eraser holding member 20 so as to cover the eraser jacketed by the eraser jacket 18.

Figure 13:
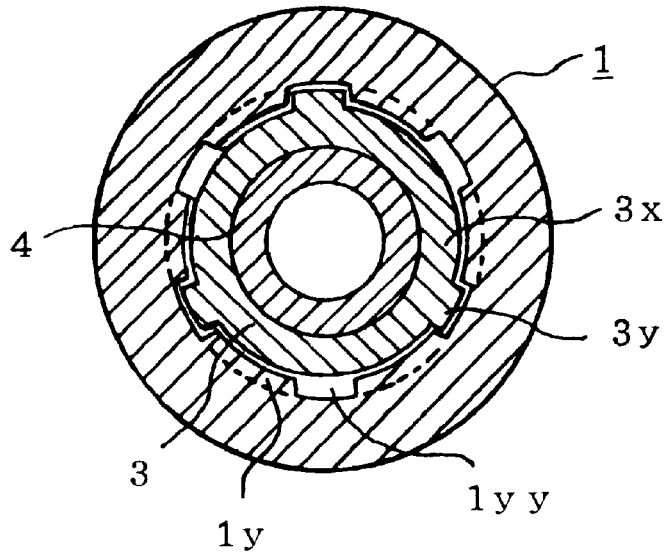
FIG. 13 is a cross-sectional view taken on line B—B in FIG. 12.

As shown in FIG. 13, three longitudinal ribs 3*y* are formed in the outer circumference of the expanded portion 3*x* of the adapter 3, and six longitudinal grooves 1*yy* are formed in a thick portion 16 of the barrel 1 corresponding to the expanded portion 3*x* of the adapter 3. The longitudinal ribs 3*y* are fitted in the longitudinal grooves 1*yy* to restrain the adapter 3 from turning relative to the barrel 1. Preferably, the diameter of a cylindrical surface including the bottoms of the longitudinal grooves 1*yy* is equal to that of the inner circumference indicated by dotted lines in FIG. 13 of a portion of the barrel 1 contiguous with the thick portion 1*y* so that any step may not be formed between the thick portion 1*y* and the portion contiguous with the thick portion 1*y*. Thus, the thick portion 1*y* has an inside diameter smaller than that of the portion contiguous with the thick portion 1*y* by a value necessary for forming the longitudinal grooves 1*yy* to achieve a function to allow the axial sliding movement of the expanded portion 3*x* of the adapter 3 in the barrel 1 and to restrain the turning of the adapter 3 relative to the barrel 1.

Thus, the adapter 3 is able to move axially in the barrel 1, but is unable to turn relative to the barrel 1. Consequently, the adapter 3 does not turn relative to the barrel 1 even if a torque acts on the eraser holding member 20, and the lead gripped by the back lead chuck 5 and the front lead chuck 11 (FIG. 1) is never torsionally broken.

Since the barrel 1 is provided with the six longitudinal grooves 1*yy* for the three longitudinal ribs 3*y* of the adapter 3, the adapter 3 can be relatively easily inserted in the barrel 1 when assembling the double-chuck mechanical pencil shown in FIG. 12. The six longitudinal grooves 1*yy* are effective in preventing the formation of sink marks when molding the barrel 1. In FIG. 12, indicated at 1*z* is a circular rib formed on the inner circumference of the barrel 1 to prevent the rattling of the adapter 3 in the barrel 1. The lead tank 4 can be easily replenished with spare leads simply by removing the push cap 19 and the eraser jacket 18 jacketing the eraser.

Figure 14:
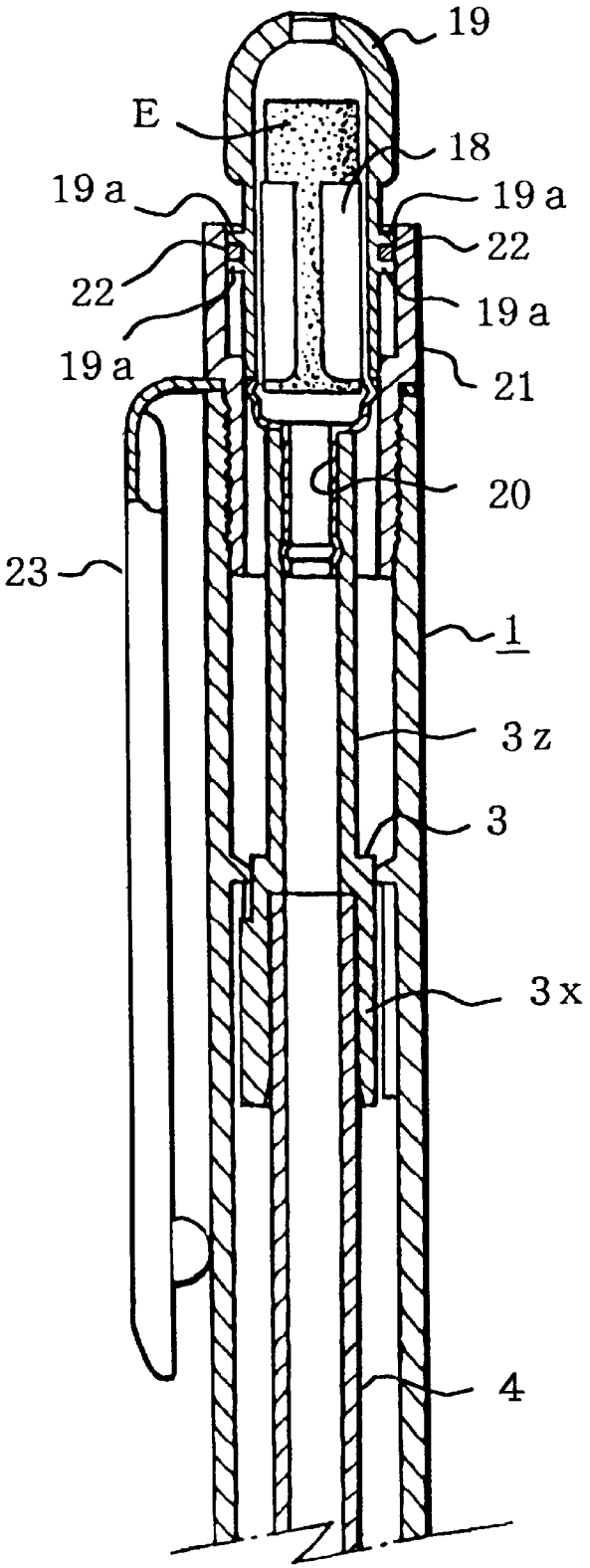
FIG. 14 is a longitudinal sectional view of a double-chuck mechanical pencil in a modification of the double-chuck mechanical pencil of FIG. 12.

FIG. 14 shows a double-chuck mechanical pencil in a modification of the double-chuck mechanical pencil shown in FIG. 12. As shown in FIG. 14, the double-chuck mechanical pencil is provided with a push cap 19 different from that of the double-chuck mechanical pencil shown in FIG. 12. Referring to FIG. 14, two circular ridges 19*a* are formed on the outer circumference of the push cap 19 at a position corresponding to the inner circumference of the end cap 21, and an elastic O ring 22 is put in a circular groove between the two circular ridges 19*a*. The O ring 22 and the circular ridges 19*a* enable the push cap 19 to move smoothly without rattling.

Figure 16:
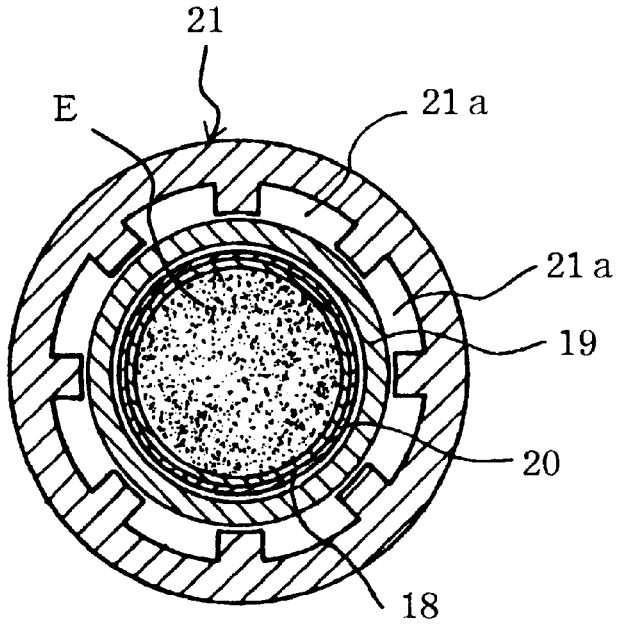
FIG. 16 is a cross-sectional view taken on line C—C in FIG. 15.
Figure 15:
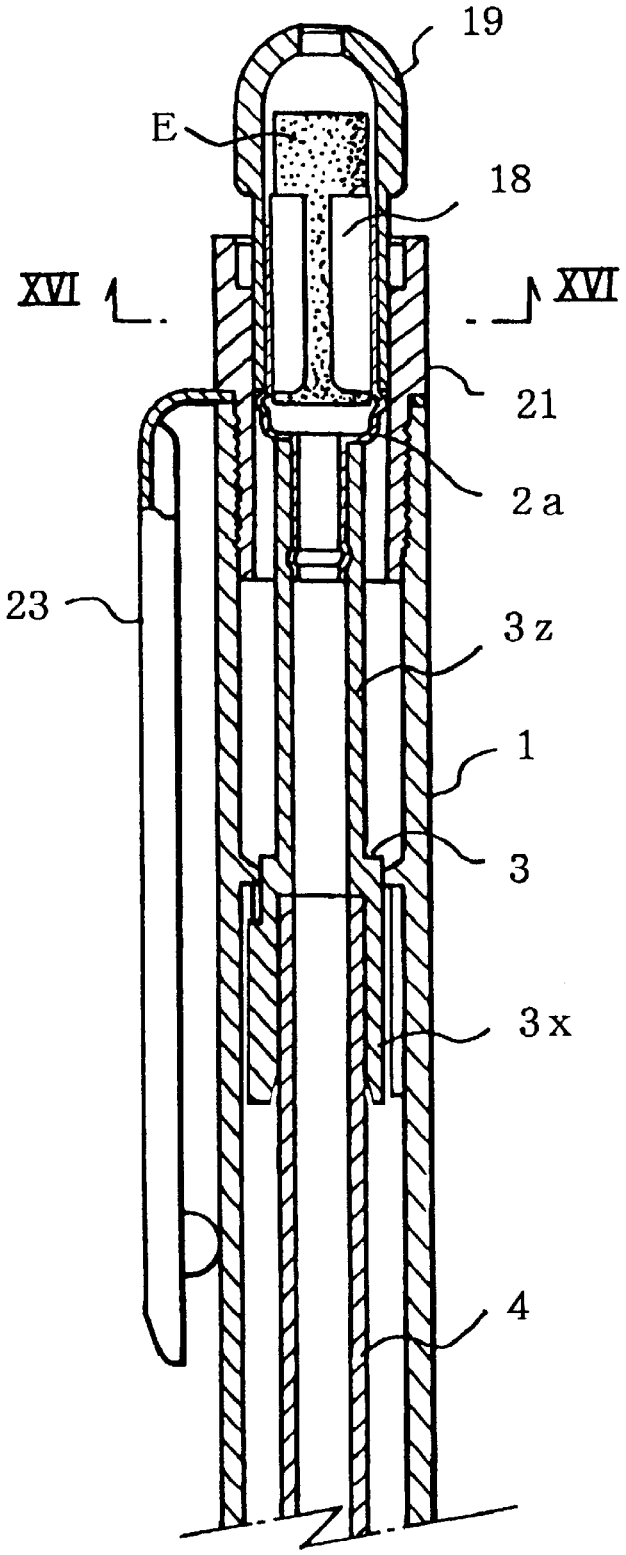
FIG. 15 is a longitudinal sectional view of a double-chuck mechanical pencil in another modification of the double-chuck mechanical pencil of FIG. 12.

FIG. 15 shows a double-chuck mechanical pencil in another modification of the double-chuck mechanical pencil of FIG. 12. An end cap 21 shown in FIG. 15 is formed by molding a synthetic resin or by die casting. The end cap 21 is provided with eight longitudinal grooves 21*a* in its inner circumference as shown in FIG. 16 to avoid the formation of sink marks.

Figure 17:
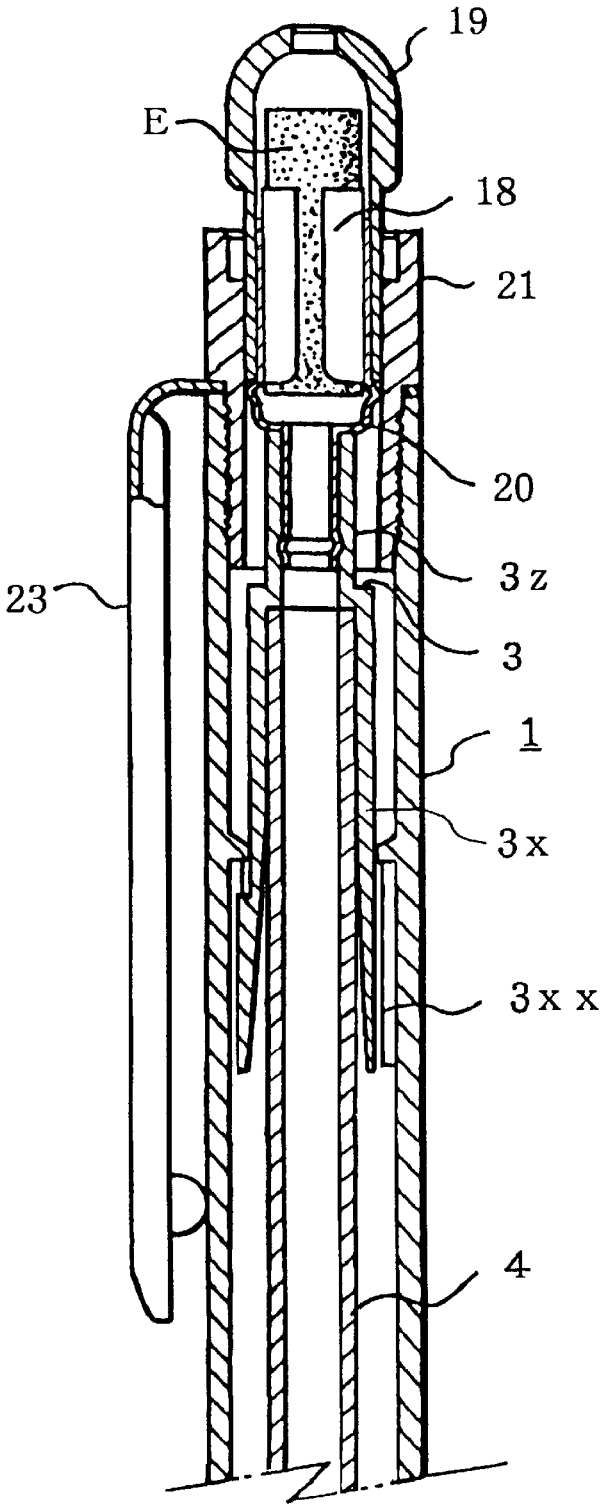
FIG. 17 is a longitudinal sectional view of a double-chuck mechanical pencil in a modification of the double-chuck mechanical pencil of FIG. 15.

FIG. 17 shows a double-chuck mechanical pencil in a modification of the double-chuck mechanical pencil of FIG. 15. The double-chuck mechanical pencil shown in FIG. 17 is provided with an arrangement to avoid a difficulty in smoothly sliding the adapter 3 relative to the barrel 1 attributable to the expansion of the adapter 3 caused by the lead tank 4 forced into the adapter 3. As shown in FIG. 17, the longitudinal ribs 3*y* to be engaged with the longitudinal grooves 1*yy* of the barrel 1 are formed in a portion of the adapter 3 different from a portion of the same in which the lead tank 4 is inserted by a press fit, and a taper surface 3*xx* is formed in a portion of the inner circumference of the adapter 3 corresponding to the longitudinal ribs 3*y*.

The expanded portion 3*x* of the adapter 3 is relatively long and a longer back portion of the lead tank 4 is forced in the expanded portion 3*x* of the adapter 3. Therefore, a portion of the adapter 3 in which the lead tank 4 is fitted by a high press fit to cause the same portion to expand is far behind the portion of the adapter 3 in which the longitudinal ribs 3*y* fitted in the longitudinal grooves 1*yy* of the barrel 1 are formed. A taper surface 3*xx* tapering backward is formed in a portion of the inner circumference of the adapter 3 corresponding to a portion of the outer circumference of the same in which the longitudinal ribs 3*y* are formed to secure a space between the adapter 3 and the lead tank 4.

Accordingly, the portion of the adapter 3 in which the longitudinal ribs 3*y* are formed is not caused to expand diametrically when the lead tank 4 is forced in the adapter 3 because the taper surface 3*xx* is formed in the inner circumference of the portion of the adapter 3 in which the longitudinal ribs 3*y* are formed even if the back portion of the lead tank 4 is forced in a reduced portion 3*z* of the adapter 3 and reduced portion 3*z* is caused to expand slightly. Therefore, the adapter 3 is able to slide smoothly axially relative to the barrel 1, the taper surface 3*xx* guides the lead tank 4 when forcing the lead tank 4 in the adapter 3.

The present invention exercises the following effects.

a. The eraser projecting mechanism or the eraser support structure is formed in a unit, the eraser will not be turned even if the eraser is pressed firmly against a paper sheet to rub off pencil marks, and the back lead chuck connected to the lead tank will not be turned and hence the lead gripped by the back lead chuck and the front lead chuck will not be torsionally broken.

b. The eraser can be easily removed together with the eraser projecting mechanism or the eraser support structure when replenishing the lead tank with leads even if the originally elastic eraser has become brittle due to aging, the eraser has been abraded or the shape of the eraser has changed without touching the eraser soiled with carbon.

c. Since a desired length of the eraser can be pulled out of the eraser jacket when the eraser is abraded, the eraser can be used economically.

d. Since the adapter serves as a spacer as well as a means for restraining the lead tank from turning relative to the barrel, the lead tank does not rattle even if a large force is applied to the eraser when using the eraser, and the lead is never able to be held accidentally between the barrel and the lead tank.

e. Since the eraser is not attached directly to the adapter, the adapter need not be provided with any step in its inner circumference for limiting the insertion of the eraser into the adapter, leads can be supplied smoothly into the lead tank.

f. Since the eraser is used in combination with the support member which can be used in combination with either the rotary eraser projecting mechanism or the eraser support structure, and the respective main portions of the double-chuck mechanical pencil employing the rotary eraser projecting mechanism and the double-chuck mechanical pencil employing the eraser support structure are the same in construction, main portion of those double-chuck mechanical pencils can be manufactured on the same production line.

g. The restraining means of a simple construction is formed by the longitudinal ribs formed in the outer circumference of the front portion of the adapter, and the longitudinal groove formed in the inner circumference of the barrel.

h. The restraining means between the adapter and the barrel is separated longitudinally from a portion of the adapter in which the lead tank is forced in, unsmooth sliding movement of the adapter relative to the barrel can be prevented.

What is claimed is:

1. A double-chuck mechanical pencil comprising:

a barrel;

a head cap screwed into the forward end of the barrel;

a lead tank inserted axially slidably in the barrel;

a back lead chuck fixedly forced into a front end portion of the lead tank;

a chuck ring loosely put on the front end portion of the back lead chuck;

an elastic tube disposed in contact with the back end of the chuck ring, said elastic tube being axially movable;

a back spring positioned inside the elastic tube and extending between a front end of the elastic tube and the front end of the lead tank so as to bias the lead tank backward;

a connector directly connected in fixed relation with the elastic tube, said connector being provided in its inner circumference with stopping portions with which the chuck ring comes into contact;

a front lead chuck fixedly forced into a front end portion of the connector;

a front spring positioned inside the head cap and contacting the connector so as to bias the connector backward, the resilience of the front spring being weaker than that of the back spring;

an adapter fixed to the back portion of the lead tank, restrained from rotation relative to the barrel and being axially movable within said barrel; and a rotary eraser projecting mechanism provided with a support member restrained from rotation relative to the adapter, and detachably connected to a back portion of the adapter.

2. The double-chuck mechanical pencil according to claim 1, wherein the rotary eraser projecting mechanism comprises a guide pipe internally provided with a helical groove, an eraser holding member holding an eraser and guided for movement by the helical groove, said support member is provided with a slit for guiding a projection formed on the eraser holding member, and a detaining means formed in said adapter, disposed to engage a leg included in the support member when said support member is connected to said adapter so as to allow said support member to be detachable from the adapter and unable to rotate relative to the adapter.

3. The double-chuck mechanical pencil according to claim 2, wherein a plurality of longitudinal ribs are formed on the inner circumference of the adapter and the outer circumference of the leg of the support member.

4. The double-chuck mechanical pencil according to claim 2, wherein the front and the back ends of the adapter, and the leg of the support member are chamfered.

5. The double-chuck mechanical pencil according to claim 1, wherein the adapter is provided with a circular ridge on its inner circumference, and the circular ridge has a back surface expanding toward the back.

6. A double-chuck mechanical pencil:

a barrel;

a head cap screwed into the forward end of the barrel;

a lead tank inserted axially slidably in the barrel;

a back lead chuck fixedly forced into a front end portion of the lead tank;

a chuck ring loosely put on the front end portion of the back lead chuck;

an elastic tube disposed in contact with the back end of the chuck ring, said elastic tube being axially movable;

a back spring positioned inside the elastic tube and extending between a front end of the elastic tube and the front end of the lead tank so as to bias the lead tank backward;

a connector directly connected in fixed relation with the elastic tube, said connector being provided in its inner circumference with stopping portions with which the chuck ring comes into contact;

a front lead chuck fixedly forced into a front end portion of the connector;

a front spring positioned inside the head cap and contacting the connector so as to bias the connector backward, the resilience of the front spring being weaker than that of the back spring;

an adapter fixed to the back portion of the lead tank, restrained from rotation relative to the barrel and axially movable;

an eraser support structure provided with a support member restrained from rotation relative to the adapter, and detachably connected to a back portion of the adapter.

* * * * *